US008685315B2

(12) United States Patent
Abiko

(10) Patent No.: US 8,685,315 B2
(45) **Date of Patent: *Apr. 1, 2014**

(54) CR-BASED ALLOY HAVING AN EXCELLENT STRENGTH-DUCTILITY BALANCE AT HIGH TEMPERATURE

(75) Inventor: Kenji Abiko, Miyagi (JP)

(73) Assignee: Japan Science and Technology Agency, Saitama (JP)

( * ) Notice: Subject to any disclaimer, the term of this patent is extended or adjusted under 35 U.S.C. 154(b) by 868 days.

This patent is subject to a terminal disclaimer.

(21) Appl. No.: 11/211,641

(22) Filed: Aug. 26, 2005

(65) Prior Publication Data

US 2005/0281703 A1 Dec. 22, 2005

Related U.S. Application Data

(63) Continuation-in-part of application No. 09/926,600, filed as application No. PCT/JP00/03399 on May 26, 2000, now Pat. No. 7,037,467.

(30) Foreign Application Priority Data

May 27, 1999 (JP) ..... 11/148326

(51) Int. Cl.
*C22C 27/06* (2006.01)

(52) U.S. Cl.
USPC ..... 420/428

(58) Field of Classification Search
CPC ..... C22C 27/06
USPC ..... 420/428
See application file for complete search history.

(56) References Cited

U.S. PATENT DOCUMENTS

| | | | | |
|---|---|---|---|---|
| 2,780,545 A * | 2/1957 | Blank et al. | ..... | 420/428 |
| 3,640,700 A | 2/1972 | Suzuki et al. | | |
| 3,816,111 A * | 6/1974 | Schneider | ..... | 420/428 |
| 4,118,254 A | 10/1978 | Knotek et al. | | |
| 5,662,864 A | 9/1997 | Kato et al. | | |
| 7,037,467 B1 * | 5/2006 | Abiko | ..... | 420/428 |

FOREIGN PATENT DOCUMENTS

| | | | |
|---|---|---|---|
| EP | 429796 | 2/1989 | |
| EP | 597129 | 5/1994 | |
| JP | 48102023 | 12/1973 | |
| JP | 49-18709 | 2/1974 | |
| JP | 49113712 | 10/1974 | |
| JP | 55154542 | 12/1980 | |
| JP | 64-7145 | 2/1989 | |
| JP | 3-162545 | 7/1991 | |
| JP | 6-49604 | 2/1994 | |
| JP | 7-278718 | 10/1995 | |
| JP | 8-225899 | 9/1996 | |
| JP | 08-225899 | * 9/1996 | ..... C22C 38/00 |
| JP | 11-80902 | 3/1999 | |
| WO | 0073523 | 7/2000 | |

OTHER PUBLICATIONS

Hansen, Max, McGraw-Hill Book Company, 1958, Constitution of Binary Alloys: "Cr—Fe Chromium—Iron", pp. 525-530.*
Abstract and English Machine Translation of Abiko (JP 08-225899) (1996).*
Dai Kou Ken News, No. 43, No. 3; Apr. 1999.
English Language Abstract of JP 7-278718; Oct. 1995.
English Language Abstract of JP 8-225899; Sep. 1996.
English Language Abstract of JP 48-102023; Dec. 1973.
English Language Abstract of JP 55-154542; Dec. 1980.
English Language Abstract of JP 11-80902; Mar. 1999.
English Language Abstract of JP 3-162545; Jul. 1991.
English Language Abstract of JP 6-49604; Feb. 1994.
English Language Abstract of JP 49-113712; Oct. 1974.
English Language Abstract of JP 49-18709; Feb. 1974.
Partial English Translation of Dai Kou Ken News, No. 43, No. 3; Apr. 1999.
Machine translation of JP 08-225899, Sep. 1996.
E. Baerleckefl et al.: Stahl u Eisen., 81 (1961), 768.
Koji Yano and Kenji Abiko, Materials Transactions, JIM, vol. 41, No. 1 (2000), 122-129.
K. Abiko: The Encyclopedia of Materials, Science Technology, Article Number: Iron, Ultrahigh-Purity/May 2001, Ed. Buschow, Chan, Fleming, Veyssiere, Kramer, Elsevier Science, 2nd Ed. By Web Oct. 2002, vol. 11, p. 1-9.
Binder et al., "The Infouence of Chromium on the Mechanical Properties of Plain Chromium Steels", Transactions, American Society for Metals, vols. 43, 1950, pp. 759-772.
Abiko, "Research of High Purity Ion and Iron Alloys", Metals & Technology, 1995, vol. 65, No. 1, pp. 53-58.
Wert, Precipitation from Solid Solutions of C and N in α-Iron, Journal of Applied Physics, vol. 20, Oct. 1949, pp. 943-949.

* cited by examiner

*Primary Examiner* — Jessee Roe
(74) *Attorney, Agent, or Firm* — Greenblum & Bernstein, P.L.C.

(57) ABSTRACT

A strength-ductility balance at a high temperature above 1000° C., particularly a high temperature above 1050° C. is improved by rendering a chemical composition of Cr-based alloy into Cr: more than 60 mass % but less than 65 mass %, C+N: not more than 20 mass ppm, S: not more than 20 mass ppm, O: not more than 100 mass ppm, O as an oxide: not more than 50 mass ppm, and the remainder being Fe and inevitable impurities.

8 Claims, 2 Drawing Sheets

| | Cr mass% | S mass ppm | O mass ppm | O as Oxide mass ppm |
|---|---|---|---|---|
| ○ | 65 | 1.0～5.0 | 10～20 | 12～ 18 |
| △ | 65 | 35～40 | 35～45 | 30～ 40 |
| □ | 65 | 5～10 | 120～150 | 80～100 |

CR-BASED ALLOY HAVING AN EXCELLENT STRENGTH-DUCTILITY BALANCE AT HIGH TEMPERATURE

This application is a Continuation-In-Part Application of U.S. application Ser. No. 09/926,600, filed May 26, 2000, now U.S. Pat. No. 7,037,467, which is hereby incorporated by reference in its entirety, and which is a National Stage of PCT/JP00/03399, filed May 26, 2000. The present application claims priority under 35 U.S.C. §119 of Japanese application Ser. No. 11/148326, filed May 27, 1999, which is hereby incorporated by reference in its entirety.

TECHNICAL FIELD

This invention relates to a Cr-based alloy having an excellent strength-ductility balance at high temperatures (not lower than 1000° C., particularly super-high temperature zone of not lower than 1050° C.).

BACKGROUND ART

With the advance of techniques in recent industrial and manufacturing fields and the rise of interest in environmental problem, it is strongly demanded to develop metallic materials having high strength and ductility at higher temperatures, particularly a high temperature zone of not lower than 1000° C.

Incidentally, high-temperature materials used from the old time were mainly Ni-based, Cr-based and Co-based alloys. For example, JP-A-55-154542 proposes Ni-based alloy comprising Cr: 20~35 wt %, Si: 1~8 wt % and C: 1.7~3.5 wt % and forming $M_7C_3$ type carbide, and also JP-A-61-7145 proposes Ni—Co—Cr based alloy comprising Ni: 20~47 wt %, Co: 6~35 wt %, Cr: 18~36 wt %, C: 0.6~2.5 wt % and Si: 0.5~2.5 wt %. However, all of these alloys could be practically used up to only a temperature of about 500° C. And also, these alloys containing a greater amount of Ni or Co have many problems that the cost of the material itself is very expensive and the thermal expansion coefficient is high.

A Cr-based alloy is hopeful as a high-temperature material being cheaper than Ni- or Co-based alloy and small in the thermal expansion coefficient. For example, JP-A-11-80902 proposes a high-Cr alloy containing C: 0.5~1.5 wt %, Si: 1.0~4.0 wt %, Mn: 0.5~2.0 wt % and Cr: 35~60 wt % and enhancing a resistance to erosion and corrosion at a higher temperature. However, even in this high-Cr alloy, it is difficult to obtain a sufficient strength at a high temperature zone, particularly above 1000° C. In order to further increase the strength of such a Cr-based alloy, it is required to more increase the Cr amount. In the conventional technique, however, when the Cr amount is not less than 60 mass %, the ductility is substantially lost, so that there is a problem that the working after the production is impossible. Therefore, the alloy containing Cr of not less than 60 mass % has been not yet put into practical use.

As mentioned above, practical materials having a sufficient strength at the high temperature and a good workability (ductility) is not existent in spite of a situation that it is more increased to demand materials durable to use under a super-high temperature environment.

It is, therefore, an object of the invention to solve the above problems of the conventional technique and to provide Cr-based alloys having an excellent strength-ductility balance, which has never been attained in the conventional alloy, at a high temperature above 1000° C., particularly a high temperature above 1050° C.

DISCLOSURE OF INVENTION

The inventors have made various studies in order to solve the above problems by using the Cr-based alloy useful from economical reason and thermal expansion coefficient. As a result, it has been found that even in the Cr-based alloy containing Cr of more than 60 mass % but less than 65 mass %, the ductility can be provided and the high-temperature strength and ductility can be established by controlling contents of C+N, S and O in the alloy and an amount of an oxide to not more than limiting amounts and the invention has been accomplished.

The invention lies in a Cr-based alloy having an excellent strength-ductility balance at higher temperatures, comprising Cr: more than 60 mass % but less than 65 mass %, C+N: not more than 20 mass ppm, S: not more than 20 mass ppm, O: not more than 100 mass ppm, O as an oxide: not more than 50 mass ppm, and the remainder being Fe and inevitable impurities.

BEST MODE FOR CARRYING OUT THE INVENTION

Firstly, there is described an experiment arriving at the invention with reference to Cr-based alloy of Cr: 65 mass % as a reference example.

Various Cr-based alloys containing 65 mass % of Cr are produced by changing purities of starting materials and melting conditions and shaped into rod-shaped specimens of 25 mm by hot forging. In this case, hot forging→working→reheating→hot forging are repeated with respect to alloys hardly working into a rod because of poor workability. These rod-shaped specimens are heated to 1250° C. and water-cooled, from which round specimens of 6.5 mm in diameter and 120 mm in length are cut out. The strength (tensile strength) and ductility (reduction of cross section) at 1100° C. are measured by using these round specimens by means of a high-temperature tensile testing machine of direct current system (Greeble testing machine).

Figure 1:
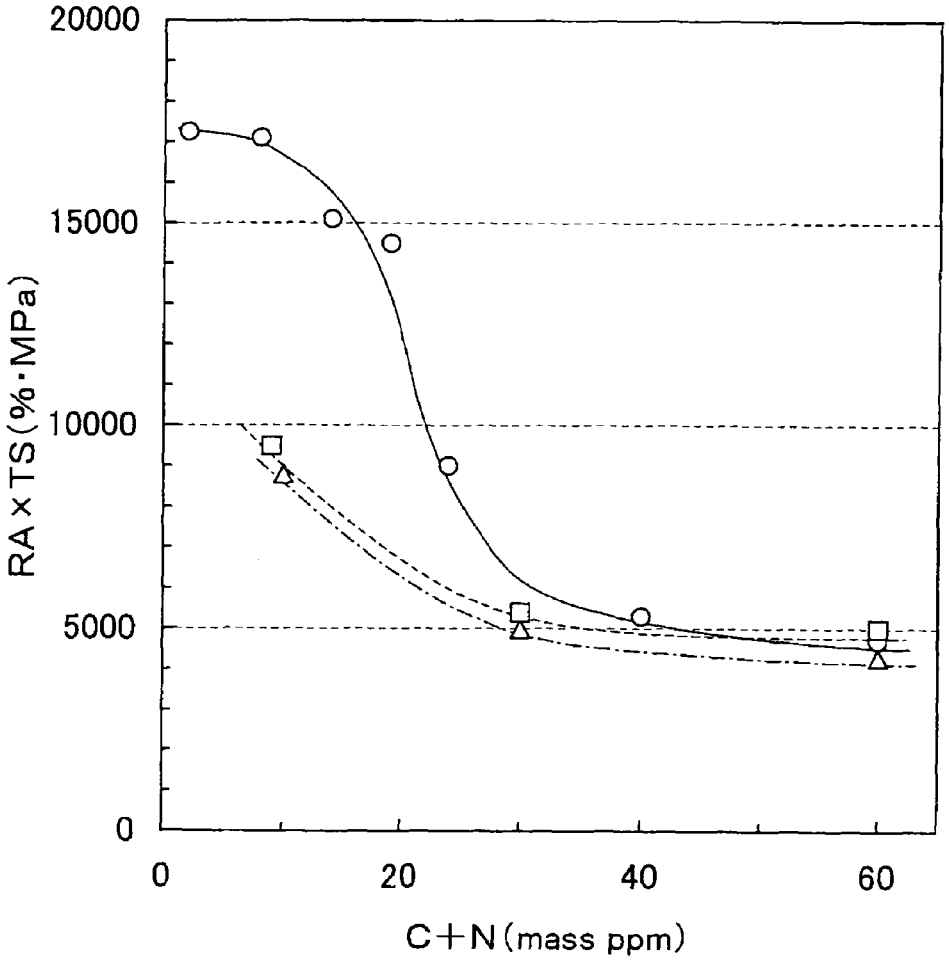
FIG. 1 is a graph showing a relation between strength-ductility balance at 1100° C. and C+N amount in a Cr-based alloy containing 65 mass % of Cr.

In FIG. 1 is shown an influence of C+N amount upon strength-ductility balance (product of reduction of cross section RA by tensile strength TS) at a high temperature. From FIG. 1, it is understood that it is required to only decrease the C+N amount but also control S amount and O amount in order to provide RA×TS≥10000 (%·MPa) as a good region of strength-ductility balance at a high temperature zone. The invention is accomplished based on such a knowledge.

The reason why the components according to the invention are restricted to the above ranges is described below.

Cr: more than 60 mass % but less than 65 mass %

Cr is an element required for ensuring the strength at the high temperature. When the amount is not more than 60 mass %, it is difficult to ensure the strength-ductility balance above 1000° C., so that it is required to be more than 60 mass %. Moreover, even if the Cr amount exceeds 65 mass %, it does not exert upon the effects of the invention.

C+N: not more than 20 mass ppm

C and N form carbonitride of Cr below 1000° C. to bring about brittleness of Cr-based alloy and degradation of corrosion resistance. And also, C and N are existent at a solid solution state at a high temperature zone above 1000° C. to lower the ductility. In order not to bring about the degradation of these properties, C+N are required to be not more than 20 mass ppm. Moreover, in order to more lessen the degradation of the ductility, C+N are favorable to be not more than 10 mass ppm. Furthermore, the lower limit is not particularly restricted, but it is desirable to be 0.1 mass ppm considering the melt production time in industry.

S: not more than 20 mass ppm

S exists in form of a sulfide with a slight amount of a metallic element such as Ti, Cu, Mn or the like slightly included in the Cr-based alloy, or segregates in a grain boundary at a solid solution state. In any case, it brings about the degradation of the ductility. Such a degradation of the ductility becomes remarkable when the S amount exceeds 20 mass ppm, so that the upper limit is 20 mass ppm. Moreover, in order to more lessen the degradation of the ductility, it is desirable to control the S amount to not more than 10 mass ppm. And also, the lower limit of the S amount is not particularly restricted, but it is desirable to be 0.1 mass ppm considering the melt producing cost.

O (total O): not more than 100 mass ppm, O as an oxide: not more than 50 mass ppm O forms an oxide with a slight amount of a metallic element such as Al, Si or the like slightly included in the Cr-based alloy to bring about the degradation of the ductility. In order to avoid such a bad influence, it is necessary that the O amount (total O amount) is restricted to not more than 100 mass ppm and the O amount existing as an oxide is controlled to not more than 50 mass ppm. Moreover, in order to maintain the high ductility, it is favorable that the O amount is not more than 50 mass ppm and the O amount as an oxide is not more than 30 mass ppm. The lower limits of the O amount and the O amount as an oxide are not restricted, but they are preferable to be 5 mass ppm and 3 mass ppm, respectively, considering the melt producing cost.

In addition to the aforementioned elements, there are Fe and inevitable impurities. Moreover, the reason why the remaining element is Fe is due to the fact that Cr—Fe alloy is most advantageous from a viewpoint of the ductility and the cost.

The alloy according to the invention has excellent strength and ductility at a high temperature region above 1000° C. Such an alloy can be particularly produced according to usual manner except that starting materials having a higher purity are used and melting conditions are paid attention to. In this case, it is desirable that chromium of not less than 99.9 mass % is used as the starting material and the melting conditions are the use of skull melting process being less in incorporation of impurities from a crucible and the vacuum degree of $10^{-5}$ Torr.

EXAMPLE

Various Cr-based alloys having a chemical composition as shown in Table 1 are produced by melting. In the melt production, a high purity chromium (purity: 99.95 mass %) and a super-high purity electrolytic iron (purity: 99.998 mass %) are used and a skull melting process using a water-cooled copper crucible is adopted. The resulting ingot is hot forged at 950~1200° C. (forging is carried out by repeating hot forging→working→reheating→hot forging at a temperature region more giving a ductility) to form a rod-shaped specimen of 25 mm.

The rod-shaped specimen is heated to 1250° C. and water-cooled, from which is cut out a round specimen of 6.5 mm in diameter and 120 mm in length. The ductility (reduction of cross section) at a high temperature is measured with respect to such a specimen by means of a high-temperature tensile testing machine of direct current system (Greeble testing machine). For the comparison, the same test is carried out with respect to 54Ni-18Cr-3Mo alloy (Inconel 718) as a commercial heat-resistant material.

TABLE 1

| Alloy | Cr/mass % | C + N/mass ppm | S/ mass ppm | O/ mass ppm | O as Oxide/ mass ppm | Remarks |
|---|---|---|---|---|---|---|
| A | 50 | 0.9 | 0.6 | 9 | 4 | Comparative Example |
| B | 50 | 31 | 18 | 17 | 9 | Comparative Example |
| N | 58 | 6.7 | 7.2 | 15 | 12 | Comparative Example |
| O | 61 | 7.2 | 8.9 | 23 | 16 | Example |
| P | 63 | 5.6 | 9.2 | 19 | 23 | Example |
| D | 65 | 7.5 | 8.1 | 20 | 13 | Reference Example |
| I | 70 | 9.1 | 9.5 | 31 | 26 | Reference Example |
| M | 54Ni-18Cr-3.0Mo-18.5Fe | | — | — | — | Conventional Example |

Figure 2:
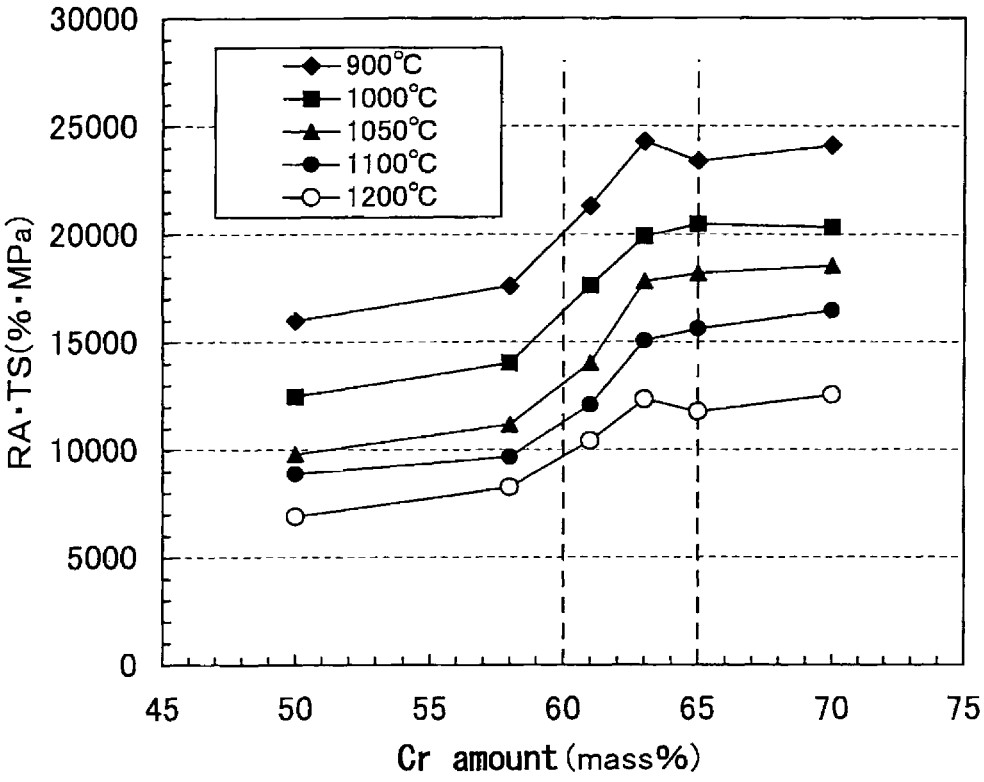
FIG. 2 is a graph showing a relation between strength-ductility balance at a temperature of 900-1200° C. and Cr amount.

The measured results of high-temperature tensile test are shown in Table 2. Also, FIG. 2 shows a relation between strength-ductility balance at a temperature range of 900-1200° C. and Cr amount in Cr-based alloys (alloys A, D, I, N, O and P) wherein amounts of C+N, S, O and O as an oxide are within the ranges defined in the invention.

TABLE 2

| | RA (%) | | | | | TS (MPa) | | |
|---|---|---|---|---|---|---|---|---|
| Alloy | 900° C. | 1000° C. | 1050° C. | 1100° C. | 1200° C. | 900° C. | 1000° C. | 1050° C. |
| A | 82 | 78 | 81 | 89 | 92 | 195 | 160 | 121 |
| B | 47 | 62 | 65 | 68 | 72 | 235 | 150 | 120 |
| N | 80 | 85 | 88 | 93 | 96 | 220 | 165 | 127 |
| O | 79 | 82 | 84 | 87 | 93 | 270 | 215 | 167 |
| P | 81 | 84 | 90 | 93 | 98 | 300 | 237 | 198 |
| D | 72 | 85 | 89 | 93 | 95 | 325 | 241 | 205 |
| I | 72 | 84 | 69 | 93 | 98 | 335 | 242 | 210 |
| M | 84 | 86 | 21 | 8 | 0 | 462 | 315 | 264 |

| | TS (MPa) | | RA × TS (% · MPa) | | | | | |
|---|---|---|---|---|---|---|---|---|
| Alloy | 1100° C. | 1200° C. | 900° C. | 1000° C. | 1050° C. | 1100° C. | 1200° C. | Remarks |
| A | 100 | 75 | 15990 | 12480 | 9801 | 8900 | 6900 | Comparative Example |
| B | 90 | 70 | 11045 | 9300 | 7800 | 6120 | 5040 | Comparative Example |
| N | 104 | 86 | 17600 | 14025 | 11176 | 9672 | 8256 | Comparative Example |
| O | 139 | 112 | 21330 | 17630 | 14028 | 12093 | 10416 | Example |
| P | 162 | 126 | 24300 | 19908 | 17820 | 15066 | 12348 | Example |
| D | 168 | 124 | 23400 | 20485 | 18201 | 15624 | 11780 | Reference Example |
| I | 177 | 128 | 24120 | 20328 | 18541 | 16461 | 12544 | Reference Example |
| M | 212 | 49 | 38808 | 27090 | 5534 | 1696 | 0 | Conventional Example |

As seen from these results, the strength at higher temperatures lowers in the alloys A, B and N having the Cr amount of not more than 60 mass %. In 54Ni-18Cr-3Mo alloy usually used as a heat-resistant material, the ductility rapidly lowers above 1000° C. and RA at 1200° C. is 0%.

On the contrary, the invention alloys containing more than 60 mass % of Cr show RA×TS≥10000 (%·MPa) representing the strength-ductility balance at higher temperatures above 1000° C., so that they have a very excellent strength-ductility balance. Also, such a good strength-ductility balance is maintained even if the Cr amount exceeds 65 mass %.

INDUSTRIAL APPLICABILITY

As mentioned above, according to the invention, there can be provided Cr-based alloys having an excellent strength-ductility balance at a higher temperature above 1000° C., particularly above 1050° C. Therefore, the invention conduces in various industry fields requiring a high-temperature material and largely contributes to the improvement of earth environment.

The invention claimed is:

1. A Cr-based alloy having an excellent strength-ductility balance at temperatures not lower than 1000° C. and having strength-ductility balance of RA×TS≥10000 (%·MPa) at 1000° C. to 1200° C., consisting of Cr: more than 60 mass % but less than 65 mass %, C+N: present in a range of 0.1 mass ppm to 20 mass ppm, S: present in a range of 0.1 mass ppm to 20 mass ppm, O: present in a range of 5 mass ppm to 100 mass ppm, O as an oxide: present in a range of 3 mass ppm to 50 mass ppm, and the remainder being Fe and inevitable impurities.

2. The Cr-based alloy according to claim 1 wherein the O as an oxide is present in a range of 3 mass ppm to 30 mass ppm.

3. The Cr-based alloy according to claim 1 wherein the O is present in a range of 5 mass ppm to 50 mass ppm.

4. The Cr-based alloy according to claim 3 wherein the O as an oxide is present in a range of 3 mass ppm to 30 mass ppm.

5. The Cr-based alloy according to claim 1 wherein the S is present in a range of 0.1 mass ppm to 10 mass ppm.

6. The Cr-based alloy according to claim 5 wherein the O as an oxide is present in a range of 3 mass ppm to 30 mass ppm.

7. The Cr-based alloy according to claim 5 wherein the O is present in a range of 5 mass ppm to 50 mass ppm.

8. The Cr-based alloy according to claim 7 wherein the O as an oxide is present in a range of 3 mass ppm to 30 mass ppm.

* * * * *